US009272174B2

(12) United States Patent
Carter et al.

(10) Patent No.: US 9,272,174 B2
(45) Date of Patent: Mar. 1, 2016

(54) HANDSTAND TRAINING DEVICE

(71) Applicant: Russell Brands, LLC, Bowling Green, KY (US)

(72) Inventors: Jack Carter, Gilbert, AZ (US); James Kaslik, Gilbert, AZ (US)

( * ) Notice: Subject to any disclaimer, the term of this patent is extended or adjusted under 35 U.S.C. 154(b) by 171 days.

(21) Appl. No.: 13/966,193

(22) Filed: Aug. 13, 2013

(65) Prior Publication Data

US 2015/0051057 A1 Feb. 19, 2015

(51) Int. Cl.

| | |
|---|---|
| ***A63B 21/00*** | (2006.01) |
| ***A63B 26/00*** | (2006.01) |
| *A63B 1/00* | (2006.01) |
| *A63B 4/00* | (2006.01) |
| *A63B 5/11* | (2006.01) |

(52) U.S. Cl.

CPC ..... *A63B 21/00054* (2013.01); *A63B 21/4037* (2015.10); *A63B 26/003* (2013.01); *A63B 1/00* (2013.01); *A63B 4/00* (2013.01); *A63B 5/11* (2013.01); *A63B 2208/028* (2013.01)

(58) Field of Classification Search

CPC ..... A63B 21/00
USPC ..... 482/33–37
See application file for complete search history.

(56) References Cited

U.S. PATENT DOCUMENTS

| | | | | |
|---|---|---|---|---|
| 860,517 | A * | 7/1907 | Berglund | 482/41 |
| 3,879,033 | A | 4/1975 | Martin | |
| 6,743,152 | B2 * | 6/2004 | Weiss | 482/38 |
| 6,846,271 | B2 | 1/2005 | Publicover | |
| 7,060,001 | B2 | 6/2006 | Publicover | |
| 8,172,737 | B1 | 5/2012 | Nihlman et al. | |
| 2007/0287599 | A1 | 12/2007 | Chartrand | |
| 2008/0132384 | A1 | 6/2008 | Publicover | |
| 2011/0071004 | A1 | 3/2011 | Murphy | |
| 2011/0160021 | A1 | 6/2011 | Publicover | |
| 2011/0212814 | A1 | 9/2011 | Gehris | |
| 2012/0322622 | A1 | 12/2012 | Davis | |

* cited by examiner

*Primary Examiner* — Jerome W Donnelly
(74) *Attorney, Agent, or Firm* — Jacob Neu; Bradley Arant Boult Cummings, LLP

(57) ABSTRACT

A training device for passively supporting a gymnast while learning and practicing handstands and handstand turns is herein disclosed. In some embodiments, the device has a base, an apparatus attachment attachable to the base for a gymnast to practice on various pieces of gymnastics equipment, and a supporter that may be set at a desired height to provide passive support to a gymnast. The support may be fastened or engaged to a tower, which is mounted to or positioned along the base.

5 Claims, 9 Drawing Sheets

HANDSTAND TRAINING DEVICE

FIELD OF THE INVENTION

The invention relates generally to gymnastics training devices. More particularly, the invention relates to a device for training gymnasts to perform handstands and handstand turns on a variety of gymnastics apparatuses.

BACKGROUND ART

Gymnastics training requires a variety of strong athletics skills, including balance, strength, flexibility, and graceful movements. One basic skill for any competitive gymnast is a handstand. Additionally, gymnasts must perform various actions while entering into or maintaining a handstand, such as handstand turns, jumps, or "walks." Therefore, it is necessary for a gymnast in training to develop confidence when entering into, maintaining, and coming out of handstands. The gymnast must further be able to perform these maneuvers while on any of various gymnastics apparatuses.

Currently, a trainer or spotter assists a training gymnast while the gymnast is learning a handstand, as the gymnast is likely to lose balance. Without a trainer or spotter, the gymnast may have a higher risk of suffering injuries. Therefore, at least one trainer or spotter is typically available for each gymnast practicing a handstand. When a trainer is working with multiple gymnasts at once, the trainer would need to spot each individual gymnast. This either causes long delays while the trainer spots each gymnast, or limits the size of class the trainer can teach. Furthermore, even when a gymnast has learned the basic handstand, the gymnast must practice it on a variety of apparatuses, such as a floor mat, a single bar, parallel bars, a balance beam, or still rings. If the gymnast must practice these maneuvers while actually on the apparatus, it prevents others from also training on the apparatus.

Therefore, a need exists for a device that can support gymnasts in keeping their balance while learning handstands such that a trainer need not always be available to spot the gymnast, and allows the gymnast to practice on a variety of apparatuses.

SUMMARY OF THE INVENTION

The disclosed device is a training device for gymnasts practicing handstands. The device allows a gymnast to maintain balance by providing a passive support for the gymnast's legs or torso while performing a handstand or various handstand maneuvers and helps the gymnast learn the appropriate vertical positioning necessary for maintaining a strong handstand. Additionally, in some embodiments, the device includes interchangeable attachments that allow the gymnast to practice on various gymnastics apparatuses. In other embodiments, the training device may be broken down easily so as to be transported to various locations.

In some aspects, the invention relates to a supporter adapted to be removably positioned on or near a gymnastics apparatus and adapted to passively support a user's legs.

In other aspects, the invention relates to a gymnastics training device having a base, at least one tower along a side of the base, a supporter adapted to secure to the tower at a desired height, and a gymnastics apparatus attachment adapted to secure to the base.

In other aspects, the invention relates to a gymnastics training device for providing passive support to a gymnast practicing handstands on a gymnastics apparatus, where the apparatus is selected from a group consisting of a single bar, parallel bars, a floor mat, a balance beam, a pommel horse, a trampoline, and a ring set.

Other aspects and advantages of the invention will be apparent from the following description and the appended claims.

BRIEF DESCRIPTION OF DRAWINGS

It should be noted that identical features in different drawings are shown with the same reference numeral.

DETAILED DESCRIPTION

Figure 1:
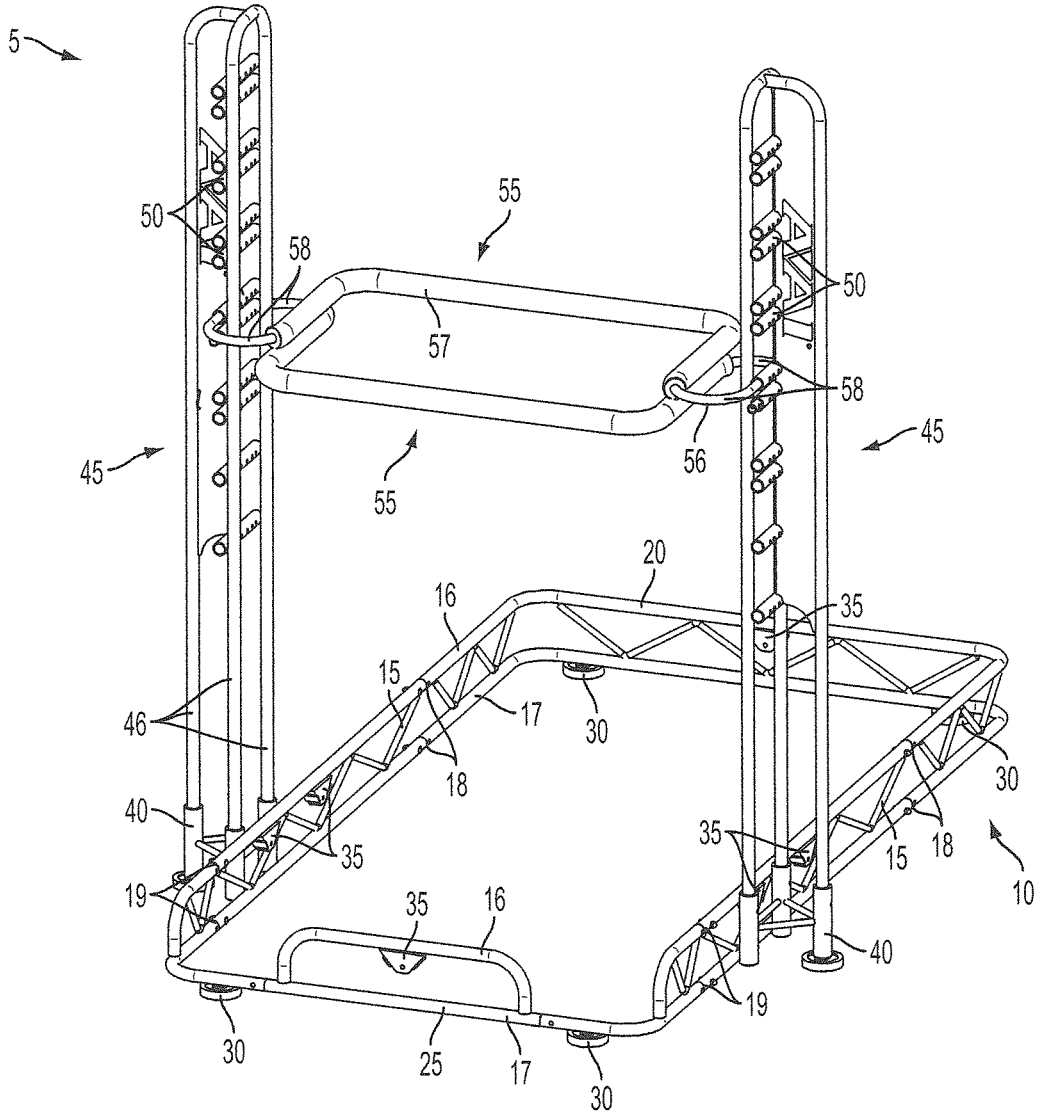
FIG. 1 is a perspective view of the training device without any attachments on the base.

FIG. 1 depicts one embodiment of a training device 5. Generally, the training device 5 has a base 10 supporting one or more towers 45. At least one supporter 55 is attached to the towers 45 and set at a height to provide a passive support to a gymnast who is practicing a handstand with the use of the training device 5 on a variety of gymnastics apparatuses or gymnastics apparatus attachments 65 (depicted on other figures).

As depicted in FIG. 1, the base 5 has two side frames 15, a front frame 20, and a back frame 25. The frames forming the base 5 may be constructed of any material of sufficient strength and rigidity to support the towers 45, the gymnastics apparatus attachment 65, and the weight and actions of the gymnast training on the device 5. By way of nonlimiting example, materials for use on the base include wood, metals such as steel, iron, or aluminum, or hard plastics, such as PVC.

In this embodiment, the side frames 15 and front frame 20 are steel trusses set between an upper bar 16 and a lower bar 17. The truss provides stability and support to the base without compromising the strength of the base 10 for supporting the other components of the device, or the gymnast. However, the truss design may not be necessary in all embodiments, and the frames could be solid or hollow beams or bars, or any other design for supporting and stabilizing the device 5.

In the embodiment depicted in FIG. 1, the back frame 25 has a single lower bar 17, with an upper bar 16 that turns down to connect to the lower bar 17. As depicted in FIG. 1, the upper bar 16 is hinged at the connection point to the lower bar 17. This facilitates the interchangeability of the gymnastics apparatus attachments 65, as further described below. In particular, the hinged upper bar 17 allows for gymnastics apparatus units 65 that are oriented front-to-back to be inserted between the front frame 20 and the back frame 25. However, when a gymnastics apparatus unit 65 is oriented horizontally, the upper bar 16 may be lowered to allow a mat 11 (shown on FIG. 3) to extend farther out the back of the device. This allows a large mat 11 to be used to cushion a gymnast rolling or falling out of a handstand and will prevent the gymnast from accidentally contacting the rear frame 25 in the event of a fall. However, it is not necessary for all embodiments that the upper bar 16 be hinged. In other embodiments, the back frame 25 may also be a truss or other appropriate design, as described with reference to the side frames 15 and front frame 20 above.

In the embodiment depicted in FIG. 1 the side frames 15, front frame 20, and back frame 25 are detachable. Detachability may be desired when the trainer or gymnast desires to transport the training device 5. Each side frame 15 connects with and secures to the front frame 20 at a joint 18. Similarly, each side frame 15 connects with and secures to the back frame 25 at a joint 19. The joints 18 and 19 may be any mechanism for allowing the frames to detachably engage. By way of example, bolts, retractable pins, friction tightening, Velcro, interlocking structures, or any other device or method for non-permanently securing the frames may be used. However, it is not necessary for all embodiments that the device 5 be portable, and the frames may be permanently secured, such as by being welded together.

The base 10 formed by the frames is sized to provide a sufficient area for a training gymnast to enter into a handstand, practice performing various maneuvers, and roll (or fall) out of the handstand. In a currently preferred embodiment, the base 10 forms a rectangle of approximately 4 feet by 7 feet, which is large enough to provide ample room for the gymnast while being small enough to allow the device 5 to be broken down and transported, should portability be desired. However, the device may incorporate any base 10 sized to provide a sufficient area to allow the gymnast to practice without interference. Furthermore, while the base 10 depicted in FIG. 1 is rectangular, the base 10 may be other shapes as well, so long as a sufficient space is provided for the gymnast to train. Optionally, a mat 11 may be provided to cushion the gymnast in the event of a fall. The mat 11 may be placed within the frames forming the base 10, thereby preventing the mat 11 from shifting during training. Alternatively, the base 10 may be sized to fit around commercially produced mats 11 of various sizes.

In the embodiment of FIG. 1, a tower base assembly 40 is secured to the outside of each side frame 15. The tower base assembly 40 provides a stable base for the towers 40, particularly when the training device 5 is constructed to be portable. To allow portability, the towers 45 should be detachable from the base 10, and the tower base assemblies 40 may be used to stabilize the towers 45 when the training device 5 is in use. The tower base assembly 40 may be detachably secured, such as by a joint described above, or it may be welded or otherwise permanently secured to the side frame 15. Alternatively, the tower base assembly 40 may be completely separate from the base 10, but this is not preferred, as securing the tower base assemblies 40 to the base 10 provides additional support and stability for the towers 45. The tower base assembly 45 is configured to support and stabilize the towers 45, and can be of any shape, size, or dimension to do so. In the embodiment depicted in FIG. 1, each tower base assembly 40 is a three-legged stand, into which the legs 46 of the tower 45 may be secured. The tower base assembly 40 is welded to the side frame 15.

A tower 45 rises vertically from each tower base assembly 40. The towers are designed for mounting one or more supporters 55. In the embodiment depicted in FIG. 1, there are two towers. More towers 45 may be used, but two provide the necessary stability for the supporter 55 while minimizing components and maximizing space around the gymnast. Alternatively, the training device 5 may utilize only one tower 45 to hold the supporter 45, but two towers 45 are currently preferred to provide additional stability. The tower 45 may be of any configuration for the supporter 55 to be mounted while remaining stable in the event the gymnast falls into or contacts the supporter 55. For example, a tower 45 may be an A-frame with two diagonal legs for support, an H-frame with two legs and a horizontal bar to which the supporter 55 can be connected, a tripod, or any other configuration that provides a mount, attachment, or otherwise fastens the supporter 55. In FIG. 1, the tower has three vertical legs 46. The legs 46 insert into the tower base assembly 40 for stability. However, if the tower has an inherently stable design, such as an A-frame, a tower base assembly 40 need not be used.

The tower 45 is of a height sufficient to set the supporter 55 at a variety of heights to passively support or provide a balance for the legs of a gymnast practicing a handstand. The tower 45 may be a set height, or it may be retractable or adjustable as desired by the trainer or gymnast to be set at an appropriate height. By experience, gymnastics trainers try to catch a gymnast at or near the lower thigh, just above the patella. The supporter 55 is preferably set at that height for each individual gymnast. Therefore, towers 45 rising up to approximately 6 feet will be sufficiently tall to accommodate all but the very tallest gymnasts. However, for children or other smaller gymnasts, the towers 45 may be smaller to increase portability. Alternatively, if the tower is to be used in conjunction with an actual apparatus, it may be taller than 6 feet.

A supporter 55 is a catch, support, halo or cage to prevent a gymnast from tipping over while practicing a handstand. In this manner, the supporter 55 provides a passive support that the gymnast can touch or "check" to regain balance while practicing a handstand or handstand turns. In the embodiment depicted in FIG. 1, the supporter 55 is a U-shaped bar or pipe 56 that connects between the towers 45. The "U" shape of the supporter 55 provides an open side which allows the gymnast to kick into or otherwise enter the handstand freely, while the pipe 56 blocks the gymnast's legs from tipping over should the gymnast kick too far forward when entering the handstand. The pipe 56 may be wrapped in padding 57 to provide cushioning in the event of a particularly hard impact. In alternative embodiments, the supporter 55 may be made of a stiff hose, plastic foam, rubber, or other non-rigid, foamed, or pliable material. This provides the gymnast with padding and some flexibility to allow the gymnast to practice maintaining a proper stance and alignment in the handstand without letting the gymnast push off or otherwise come to rely upon the presence of the supporter 55 when performing the handstand. Additionally, the supporter 55 may be hinged to allow a trainer or spotter to rotate the supporter 55 above the feet of the gymnast to another side, or to flip its positioning from front support to back support and vice versa.

FIG. 1 also depicts a second supporter 55 oriented opposite to the first supporter 55. In this configuration, the supporters 55 provide a full 360 degrees of passive support to the gymnast. If the gymnast is a novice to handstand performance, the use of a second supporter 55 provides additional passive support. In such usage, the novice gymnast is either supported by a trainer or otherwise enters the handstand by raising his legs into a handstand rather than kicking up into it. Further supporters 55 may be used to provide further stability and support along the gymnast's back or front, on either or both sides of the towers 45. While these additional supporters 55 provides these benefits, they are not necessary for using the training device 5.

In one embodiment, and as depicted in FIG. 1, in order to attach the supporter 55 to the towers 45, each tower in the embodiment of FIG. 1 has a series of tubes 50 arrayed at various heights along the tower 45 and horizontally aligned with tubes 50 attached to the opposite tower 45. The tubes 50 are of various heights so that the supporter 55 can be raised or lowered depending on the height of the gymnast. Each supporter 55 has two reverse-U-shaped ends 58 that are insertable into the tubes 50 on each tower, and the tubes are adapted to receive an end 58. When the end 58 is inserted into the tube 50, the end 58 may detachably lock into place, for example, by friction fitting, interlocking components, retractable pins, or other known mechanisms. This design provides for efficient and easy assembly of the supporter 55 for use with a particular gymnast. Furthermore, the reverse-U-shaped end 58 allows the supporter 55 to support the gymnast in the event the he falls into the supporter 55. Should the gymnast hit the supporter 55, he will push the supporter 55 in the direction of the side where the pipe 56 is located. However, this will push the ends 58 in the same direction, causing the bottom section of the "reverse-U" to catch against the tube 50, thereby preventing it from sliding out. The "reverse-U" shape of the end 58 of the supporter 55 also ensures that the gymnast will not contact the towers 45 if they lean too far to the left or right when performing the handstand.

In other embodiments, the tubes 50 may be slidable, such that a single set of tubes 50 may run on a continuous track (not shown) along the towers 45 and provide passive support at any required height. Additionally, other mechanisms for securing the supporter 55 to the tower 45 may be used. By way of example, bolts, pins, interlocking components, or other known mechanisms may be used, so long as the supporter 55 is secured well enough to the tower 50 in order to prevent the supporter 55 from coming loose in the event the gymnast hits the supporter 55. In still other embodiments, the towers 45 may be extendable or retractable, such that the supporter 55 may fasten to the tower 45 at a single location, and the height of the supporter is varied by extending or retracting the towers 45.

The training device 5 may also include any number of gymnastics apparatus attachments 65 to allow the gymnast to practice handstands on any desired apparatus. A gymnastics apparatus is a gymnastics competition device on which gymnasts perform. Such apparatuses include a mat 70, a single bar 75, a balance beam 80, parallel bars 85, a pommel horse 90, a trampoline 95, and a ring set 100. FIGS. 2-8 depict configurations using each of these apparatuses as attached to the training device 5 depicted in FIG. 1. These gymnastics apparatus attachments 65 may be permanently secured to the training device 5. However, by providing for detachable and interchangeable gymnastics apparatus attachments 65, a single training device 5 allows a gymnast to practice on multiple apparatuses.

Figure 2:
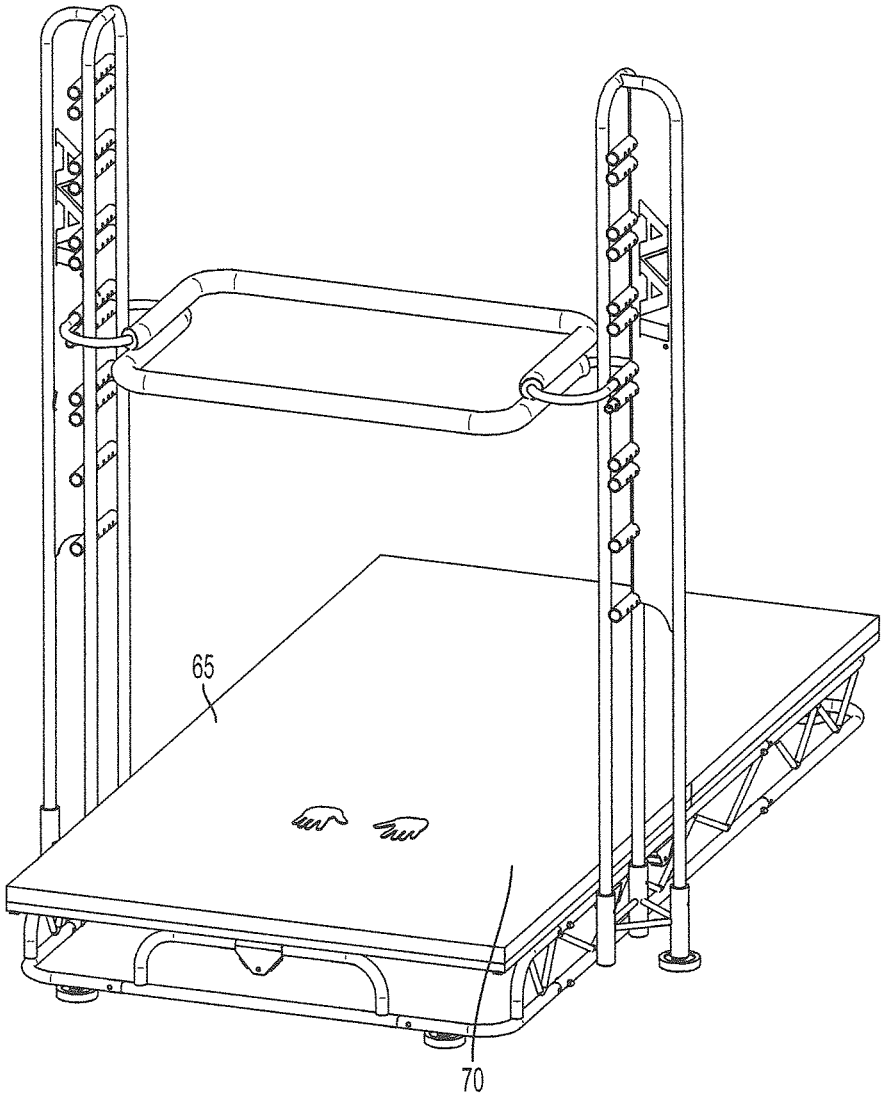
FIG. 2 is a perspective view of the training device with a matted surface attachment.

FIG. 2 depicts the gymnastics apparatus unit 65 as a floor mat 70 similar to the surface used on a floor routine in gymnastics competitions. The mat 70 is attached to and rests on the upper bar 16 of the side frames 15, front frame 20, and rear frame 25.

Figure 3:
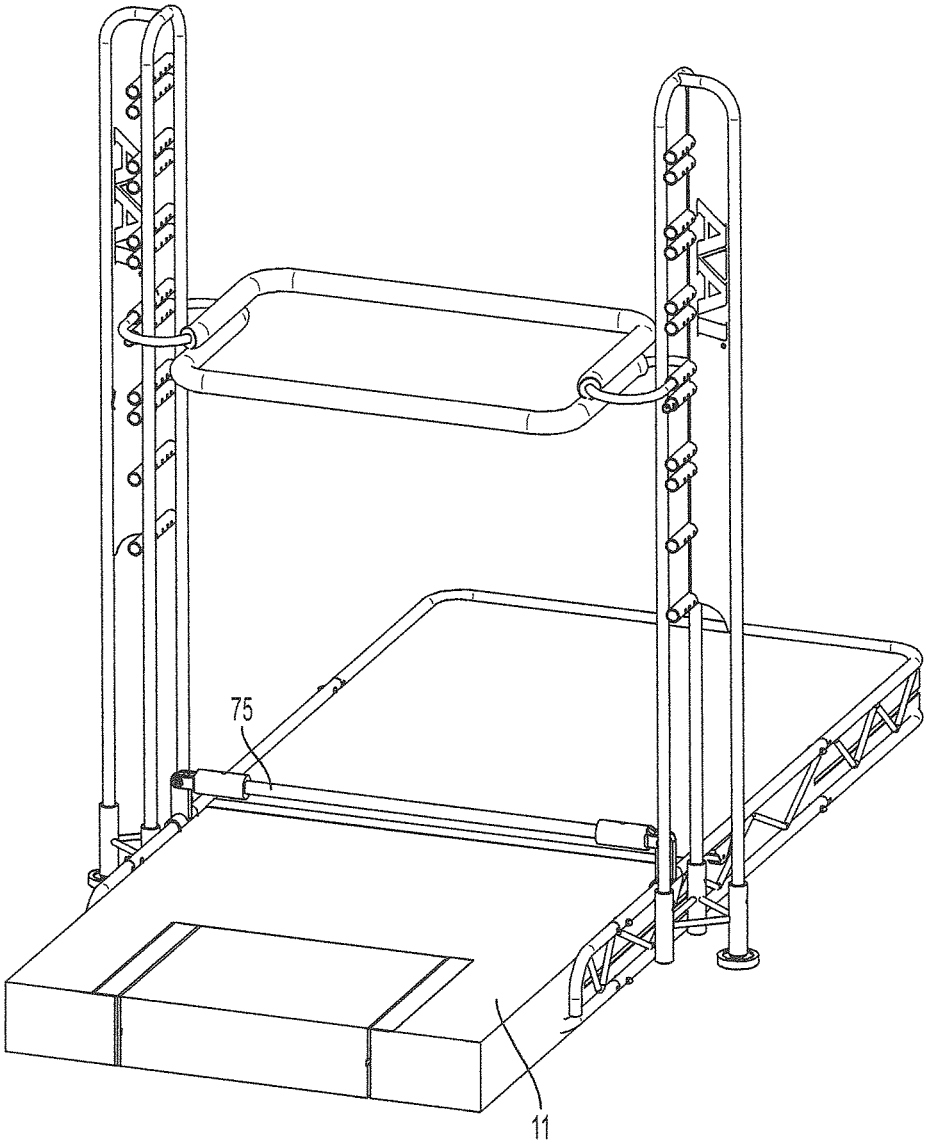
FIG. 3 is a perspective view of the training device with a single bar attachment.

FIG. 3 depicts the gymnastics apparatus unit 65 as a single bar 75, which is aligned horizontally between the towers 45. The single bar 75 may be used for female gymnasts, who compete on the uneven bar apparatus, or male gymnasts, who compete on the high bar apparatus. The single bar 75 is attached to the side frames 15 as discussed with reference to FIGS. 9 and 10 below. A mat 11 extends beyond the rear frame 25 to provide additional cushioning in the event of a fall.

Figure 4:
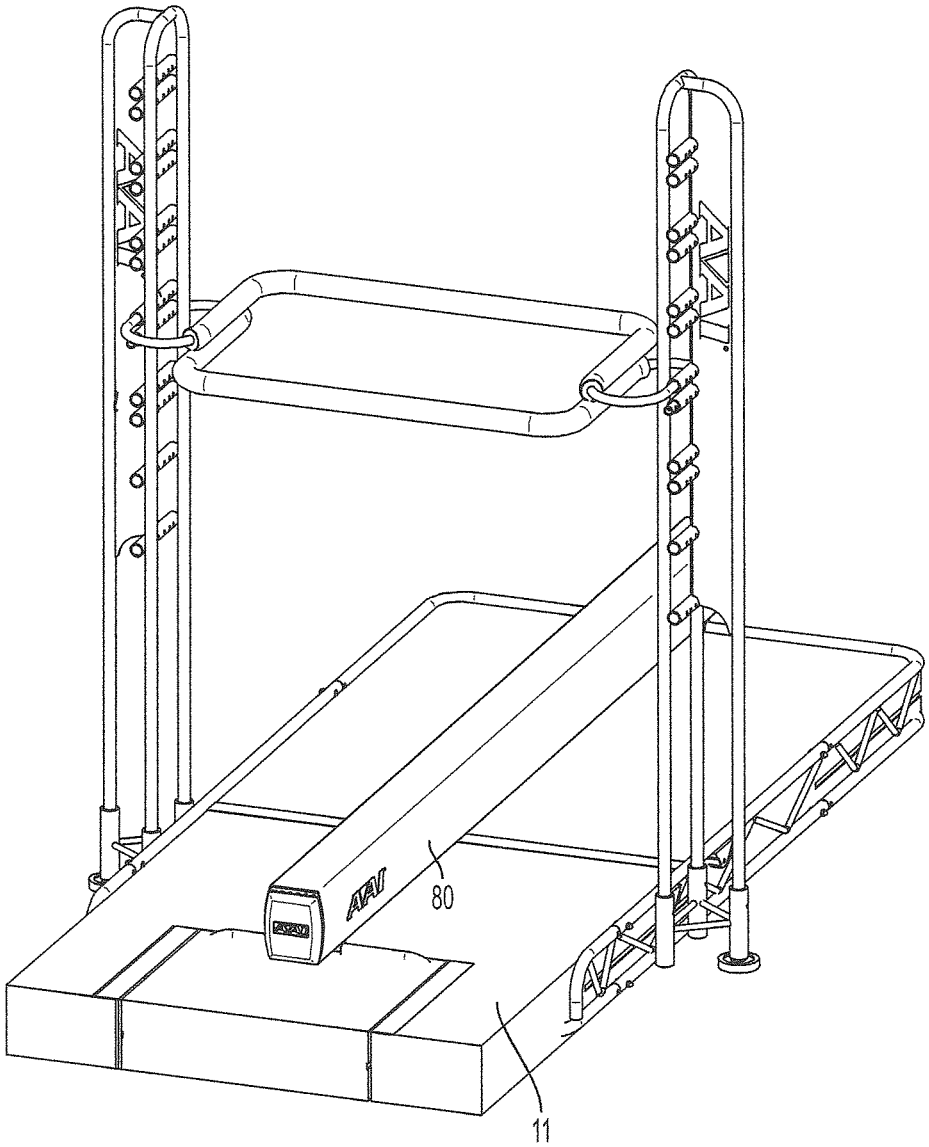
FIG. 4 is a perspective view of the training device with a balance beam attachment.

FIG. 4 depicts a balance beam 80 aligned front-to-back. The balance beam attaches to the front frame 20 and rear frame 25 as discussed with reference to FIGS. 9 and 10 below. In this embodiment, the upper bar 16 of the rear fame 25 is positioned upright and locked, so that the balance beam 80 is in proper alignment.

Figure 5:
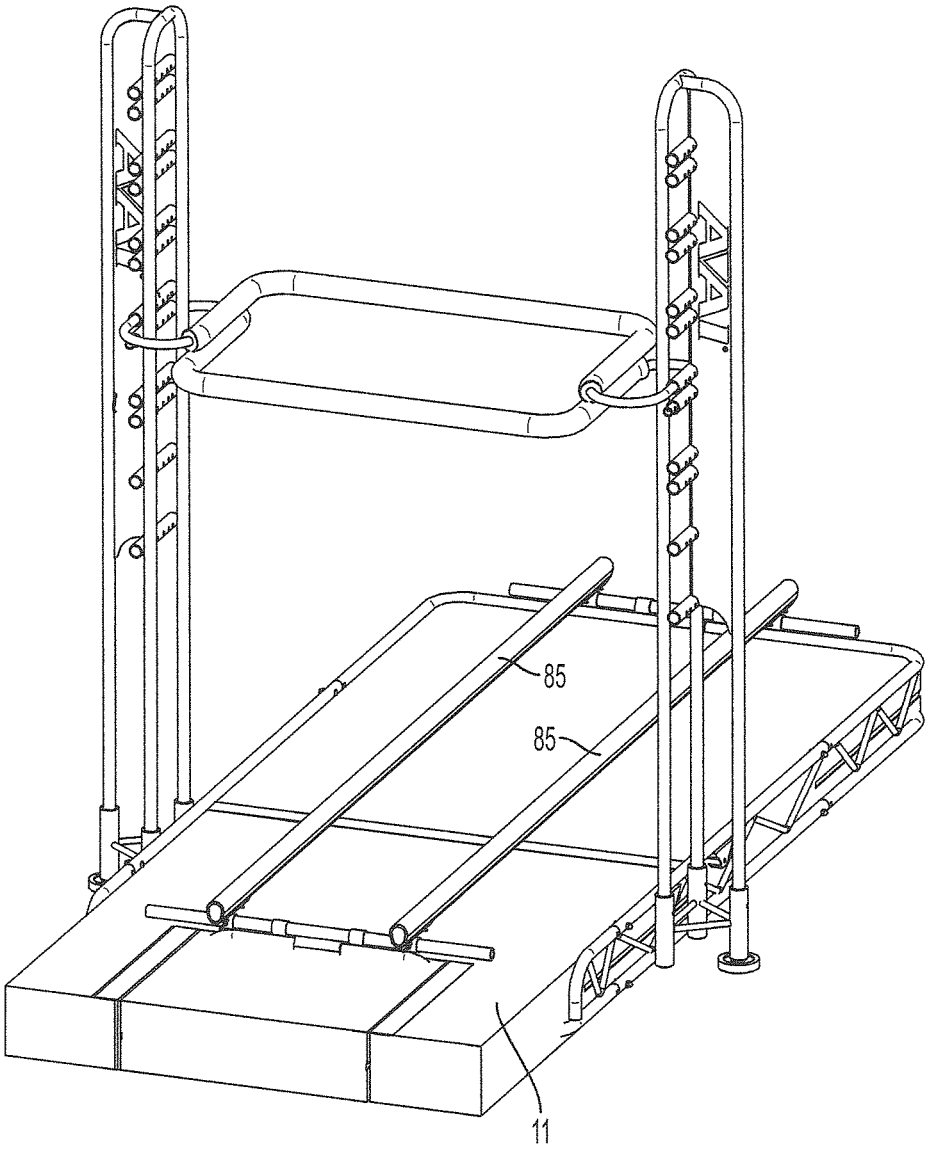
FIG. 5 is a perspective view of the training device with a parallel bar attachment.

FIG. 5 depicts a set of parallel bars 85 aligned front-to-back. The parallel bars 85 are spaced as configured during men's competition.

Figure 6:
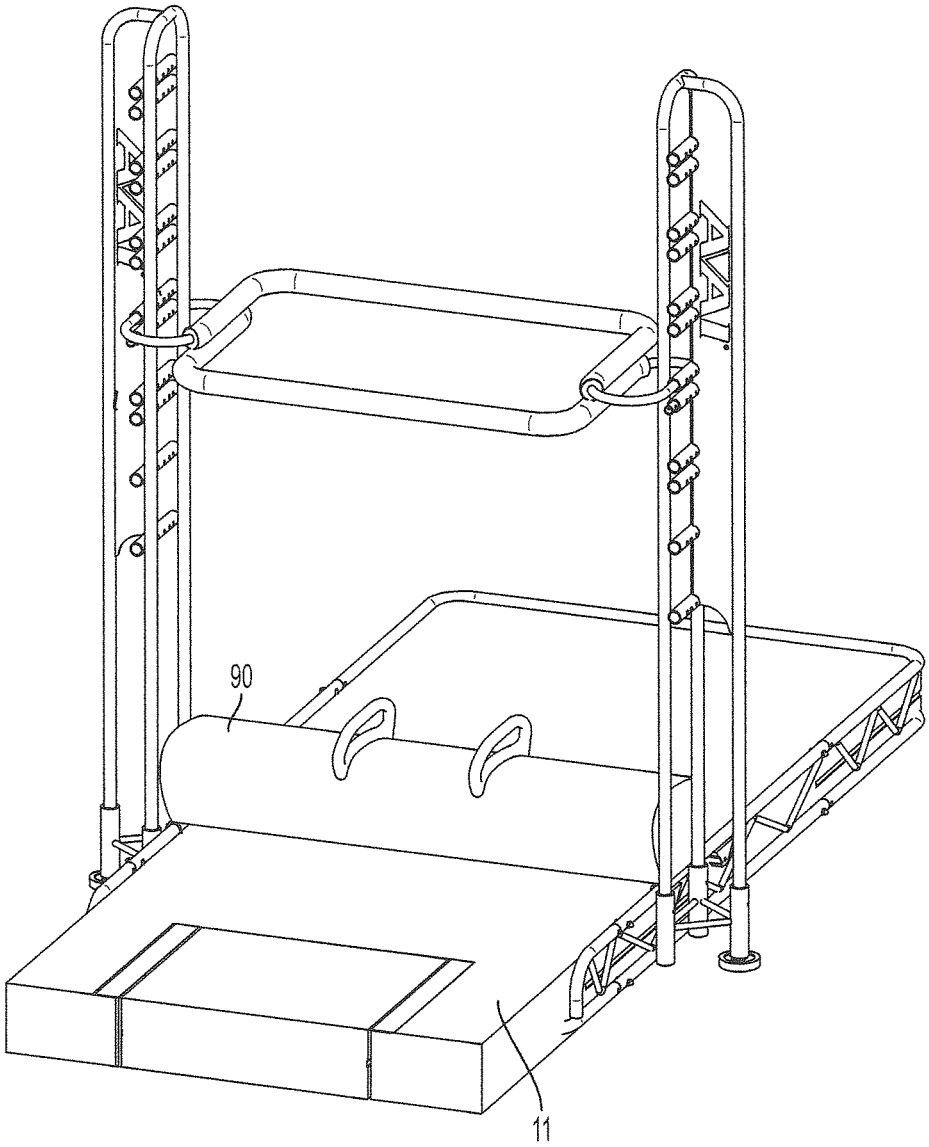
FIG. 6 is a perspective view of the training device with a pommel horse attachment.

FIG. 6 depicts a pommel horse 90, aligned such that the handles of the pommel horse 90 are in between the towers 45 and the apparatus is in a horizontal alignment. The pommel horse 90 is attached to the side frames 15 as discussed with reference to FIGS. 10 and 11.

Figure 7:
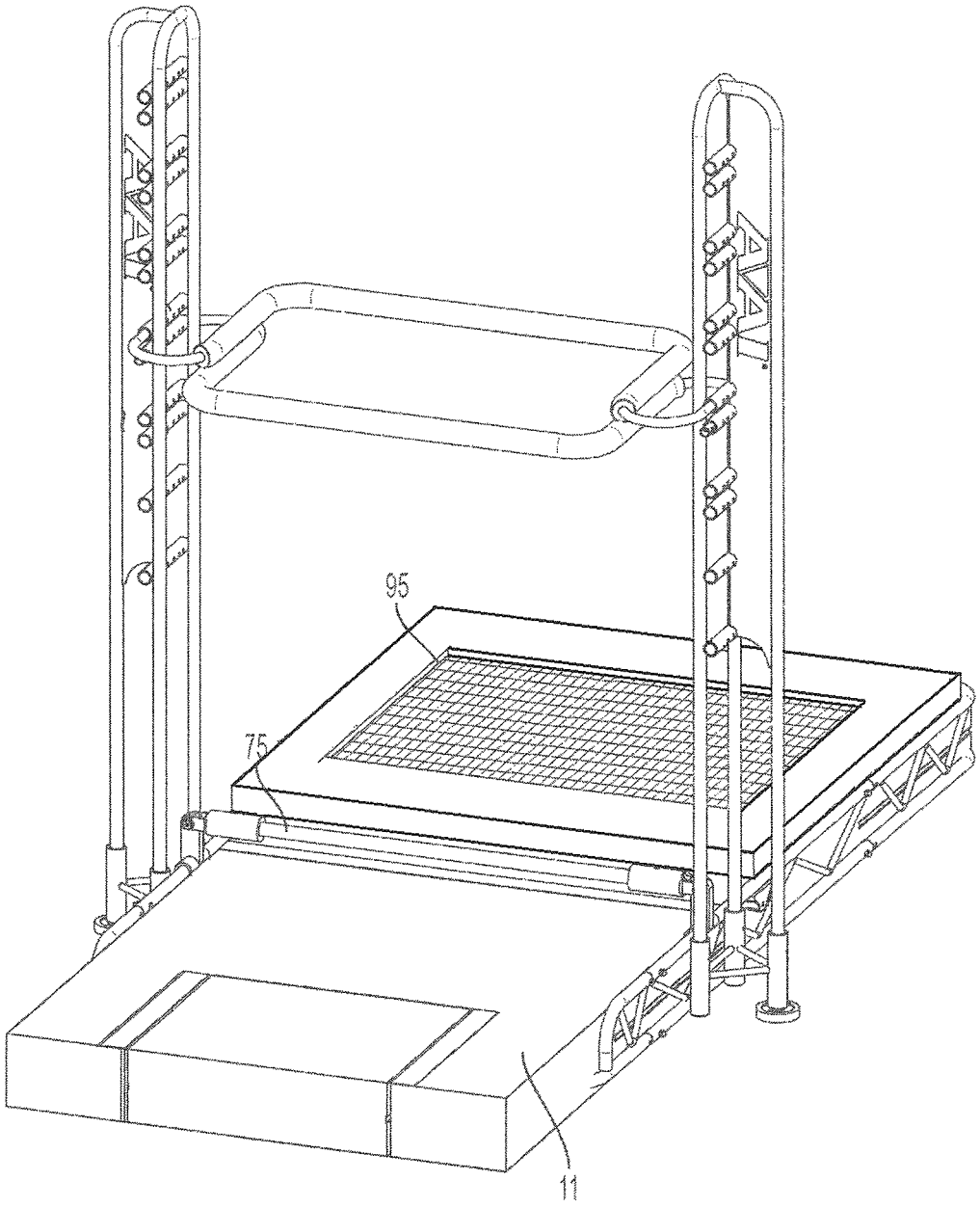
FIG. 7 is a perspective view of the training device with a trampoline surface attachment and a single bar attachment.

FIG. 7 depicts a trampoline 95 attached to the front frame 20 and side frames 15. A trampoline 95 may be used to help a gymnast practice bouncing or kicking into a handstand. In some embodiments, the trampoline 95 may be used alone. In other embodiments, and as depicted in FIG. 7, the trampoline 95 may be combined with another apparatus, such as the single bar 75, to allow the gymnast to practice jumping, kicking, or bouncing into that apparatus.

Figure 8:
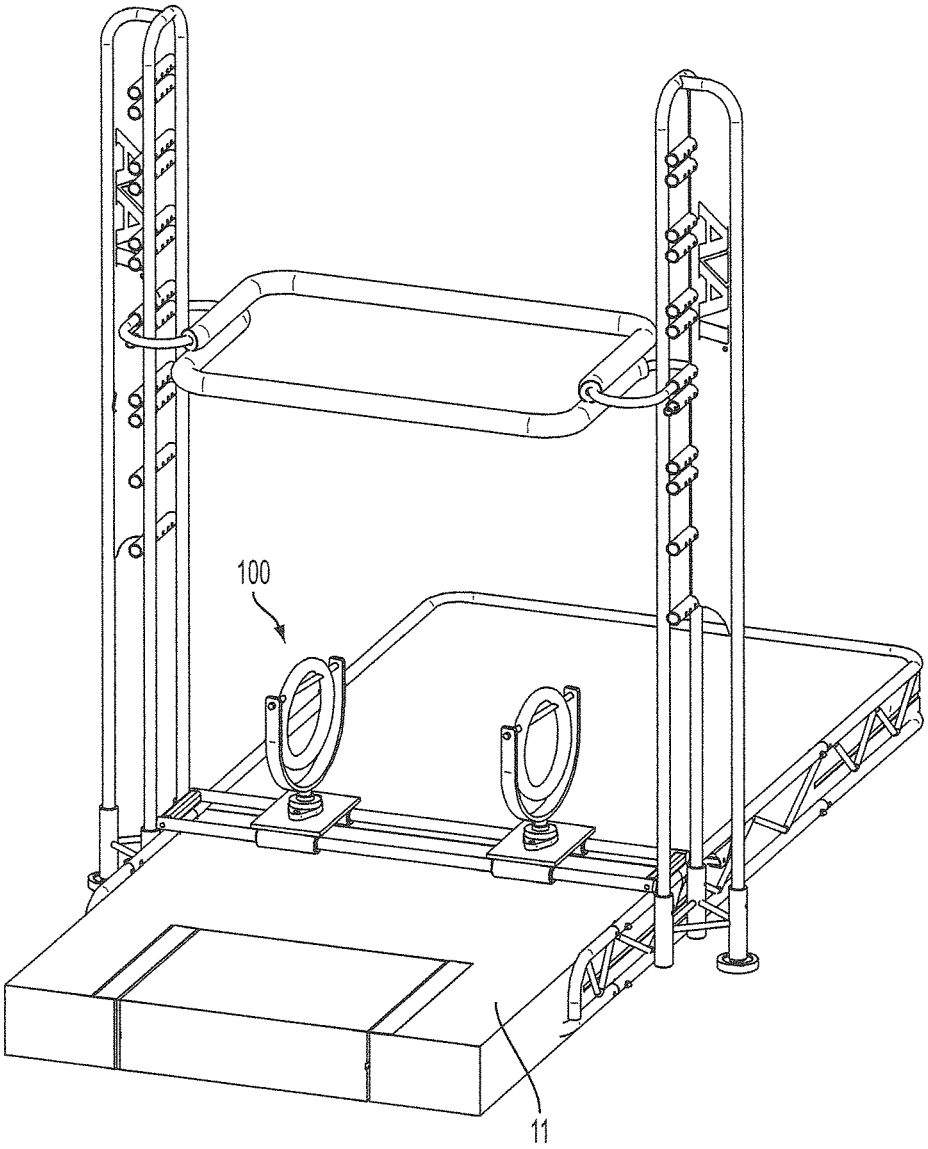
FIG. 8 is a perspective view of the training device with a ring set attachment.

FIG. 8 depicts a multi-axis ring set 100 for practicing handstands on the men's rings apparatus. The rings 100 are aligned horizontally between the towers 45. In particular the rings are positioned on a track and may be slidable or locked into position. Similarly, the rings may be allowed to rotate about one or two axes (the roll axis and the yaw axis), or they may be restricted. The trainer can restrict the motion of the rings as necessary given the gymnast's individual skill.

In some embodiments, the gymnastics apparatus attachments 65 may be secured to the base 10 or towers 45 by any known mechanism. In the embodiment depicted in FIG. 1 and further depicted in FIG. 9, accessory attachment plates 35 are provided at various locations on the side frames 15, front frame 20, and back frame 25. The accessory attachment plates 35 shown are aligned opposite each other across the base 10. Each plate 35 is a flat plate having a hole 36 in the center and guides 37 perpendicularly attached to the edges to set the right height. The guides 37 on one plate 35 are aligned with the guides 37 on the opposite plate 35.

Figure 9:
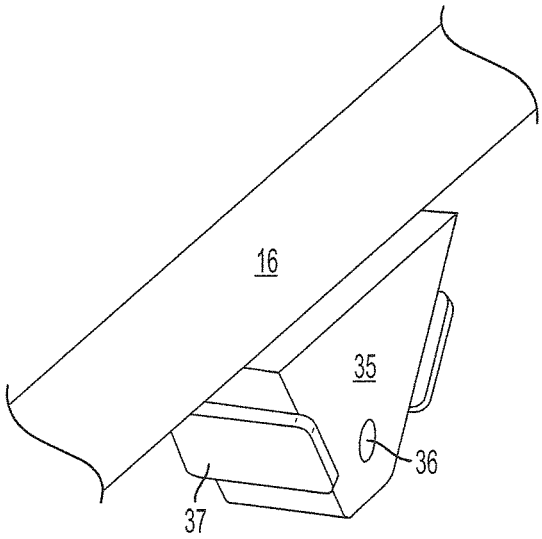
FIG. 9 is a close-up view of an accessory attachment plate as further described herein.
Figure 10:
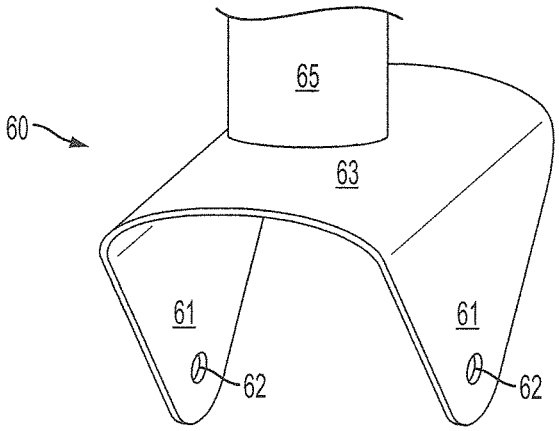
FIG. 10 is a close-up view of an apparatus attachment plate as further described herein.

For the embodiment of FIG. 9, each gymnastics apparatus attachment 65 also has a set of apparatus attachment plates 60 to secure the gymnastics apparatus attachment to the base 10 at the accessory attachment plates 35. The apparatus attachment plates 60 are depicted more fully in FIG. 10. At least two apparatus attachment plates 60 are positioned on the gymnastics apparatus opposite each other and at a distance corresponding to the distance between a set of accessory attachment plates 35 located on the base 10. Each apparatus attachment plate has a C-shaped collar or clamp 63 attached to the apparatus. The clamp 63 is sized to snugly fit onto the upper bar 16 of a side frame 15, front frame 20, or back frame 25. Two plates 61 depend down from either end of the clamp 63 and have holes 62.

To attach a gymnastics apparatus attachment 65 to the base 10, the trainer or gymnast positions the gymnastics apparatus attachment over the base such that the apparatus attachment plates 60 are proximately aligned with a desired set of accessory attachment plates 35. The trainer then sits the attachment 65 onto the upper bar 16 of the frames, such that the clamp 63 fits snugly onto the upper bar 16. As the attachment 65 is seated onto the bar 16, the guides 37 direct the apparatus attachment plates 61 into alignment with the accessory attachment plates 35. Once aligned, the holes 36 and 62 in the accessory attachment plates 35 and the apparatus attachment plates 60 are horizontally aligned. The trainer may then insert a pin (not shown) through the holes to lock the attachment 65 into place.

In other embodiments, the gymnastics apparatus unit 65 may be free standing and not attached at all to the base 10 or towers 45. This may be desirable when the trainer wants to use the training device 5 in conjunction with the actual gymnastics apparatus, in order to allow the gymnast to practice at the height that a competition may occur. For example, the men's high bar is set at a competition height of 278 cm (9 feet 1.4 inches). However, in the device 5 as depicted in FIG. 3, the single bar 75 is located very close to the mat. In order to help a gymnast learn to perform a handstand or handstand turns at competition height, the training device 5 may utilize towers 45 having an extended height to provide a supporter 55 at a height of 10-13 feet, such that the supporter 55 can support a gymnast practicing on the competition apparatus. Similarly, the training device can be used on other apparatuses.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. A gymnastics training device comprising:

a. a base;

b. a first tower, positioned along a side of the base;

c. a supporter adapted to secure to the tower at a desired height;

d. a gymnastics apparatus attachment adapted to secure to the base; and e. a second tower aligned with the first tower, where the supporter is mounted between the first and second towers and where each tower comprises a tube adapted to secure an end of the supporter, and the tubes on the towers are horizontally aligned.

2. The device of claim 1 where the tube is movable along the length of the towers.

3. A gymnastics training device comprising:

a. a base;

b. a first tower, positioned along a side of the base;

c. a supporter adapted to secure to the tower at a desired height, where the supporter is a U-shaped pipe; and d. a gymnastics apparatus attachment adapted to secure to the base.

4. The device of claim 3 where the supporter has reverse-U-shaped ends.

5. A gymnastics training device comprising:

a. a base comprising i. two side members, ii. a tower base assembly secured to each side member, iii. a front member adapted to detachably engage a first end of each side member, iv. a back member adapted to detachably engage a second end of each side member and comprising an upper bar hinged to a lower bar, and v. at least one accessory attachment plate secured to each side member, the front member, and the back member, where each accessory attachment plate is horizontally aligned with another accessory attachment plate, each accessory attachment plate comprising 1. a triangular plate mounted to the side member and having a pinhole aperture, and 2. guides along the side of the triangular plate;

b. two towers positioned opposite each other alongside the base and adapted to secure into the tower base assembly, each tower comprising i. a tube set at a desired height;

c. a supporter comprising i. a U-shaped pipe sized to fit between the two towers, ii. padding around the U-shaped pipe, and iii. two ends mounted to the U-shaped pipe, each end adapted to lockably engage the tubes; and d. a gymnastics apparatus attachment comprising i. a gymnastics apparatus unit, wherein the gymnastics apparatus unit is selected from a group consisting of a balance beam, a single bar, parallel bars, a pommel horse a padded floor slab, a trampoline surface, and a ring set, ii. at least one apparatus attachment plate comprising 1. a clamp for engaging the side member and secured to the gymnastics apparatus unit, and 2. a triangular plate mounted to the clamp and having a pinhole, such that when the apparatus attachment plate and the accessory attachment plate are aligned, the pinholes are aligned to permit a safety pin to pass through.

* * * * *